United States Patent [19]

Hall

[11] 4,133,474

[45] Jan. 9, 1979

[54] STACKING BOX CONSTRUCTION USING GLUED SIDES

[75] Inventor: Richard A. Hall, Danville, Calif.

[73] Assignee: Willamette Industries, Inc., San Leandro, Calif.

[21] Appl. No.: 854,359

[22] Filed: Nov. 23, 1977

[51] Int. Cl.[2] ..... B65D 13/00

[52] U.S. Cl. ..... 229/23 R

[58] Field of Search ..... 229/23 R, 23 BT, 14 BL, 229/14 BE

[56] References Cited

U.S. PATENT DOCUMENTS

| | | | |
|---|---|---|---|
| 2,540,595 | 2/1951 | Props | 229/23 R |
| 2,671,600 | 3/1954 | Leavett | 229/23 R |
| 2,829,815 | 4/1958 | Copeman | 229/23 R |
| 3,559,867 | 2/1971 | Mushopf et al. | 229/23 R X |
| 3,880,341 | 4/1975 | Bamburg et al. | 229/23 R |
| 3,913,822 | 10/1975 | Heaps, Jr. | 229/23 R |
| 3,979,045 | 9/1976 | Bamburg et al. | 229/23 R |

*Primary Examiner*—Davis T. Moorhead
*Attorney, Agent, or Firm*—Robert H. Eckhoff

[57] ABSTRACT

An improved construction is provided for a corrugated box container having improved column strength enabling a plurality of the containers to be stacked one upon the other and in which the lowermost containers provide an increased stacking strength against collapse.

1 Claim, 5 Drawing Figures

STACKING BOX CONSTRUCTION USING GLUED SIDES

BACKGROUND OF THE INVENTION

The necessity that containers suited for multiple stacking have good corner column strength has been recognized heretofore and one can refer to the Props U.S. Pat. No. 2,540,595 of Feb. 6, 1951 and to the Guyer U.S. Pat. No. 2,885,137 of May 5, 1959 for a box construction having value in this regard. The Guyer container, however, is assembled and the several elements are secured by rivets. I have found that a material and substantial improvement can be provided over the Props and Guyer structures if, instead of using rivets, the several box elements are secured together with glue. Gluing of some box elements, however, has heretofore been proposed in the Dornbush et al. U.S Pat. No. 3,275,217 of Sept. 27, 1966 wherein a separate inner collar is provided in an outer box structure.

SUMMARY OF THE INVENTION

It is in general the broad object of the present invention to provide an improved box construction in which an innermost tray is secured to an outer sleeve providing a closure for the tray. The tray and sleeve are secured together, however, by glue application over the several elements having interface contact so that the two are secured together and are, in effect, one in providing vastly increased column strength to the container.

Another object of this invention is to provide a box construction in which the several sides and ends of a box are integrally joined together in a face-to-face relation such that the contacting surfaces, in effect, provide one structural element and the contacting faces are not subject to tearing as is the case if the surfaces are joined by means of staples, rivets, sewing or joining means other than an adhesive such as a hot or cold glue.

DESCRIPTION OF THE PREFERRED EMBODIMENT

Figure 1:
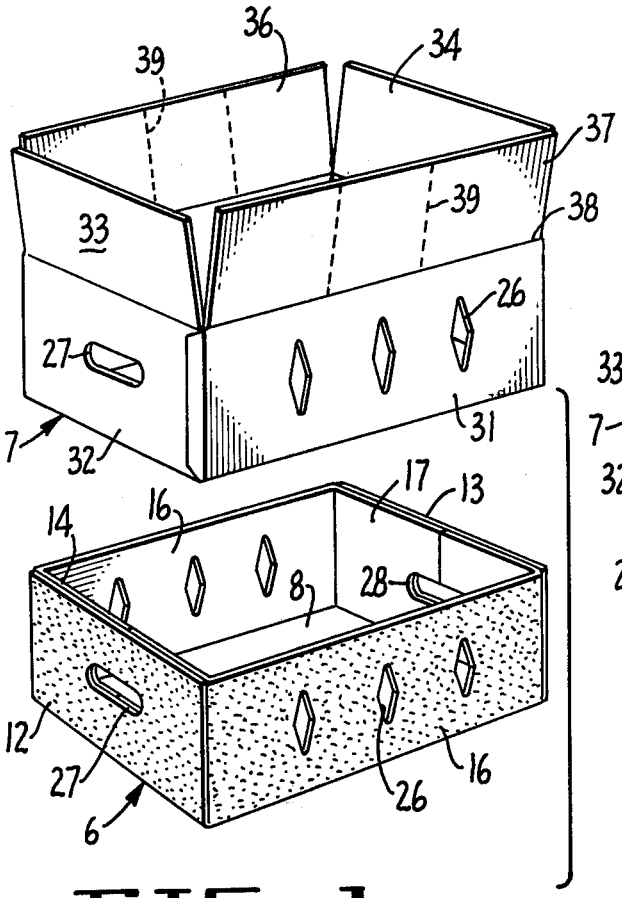
FIG. 1 is a perspective exploded view showing the sleeve superimposed over the tray and ready for assembly.
Figure 3:
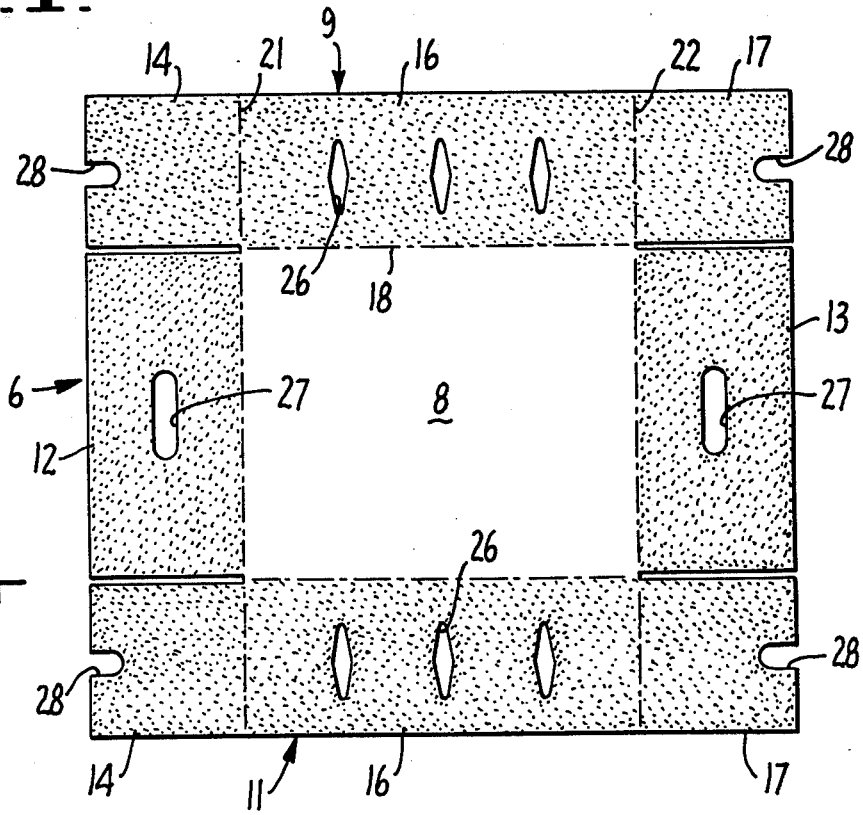
FIG. 3 is a plan view of the blank on which the tray element is formed.

Referring to the drawings and particularly to FIG. 1, the inner tray element is generally indicated at 6 while the surrounding sleeve element is generally indicated at 7. As is shown in FIG. 3, the tray element 6 is made up of a bottom panel 8, opposite side panels 9 and 11, and opposite end panels 12 and 13. Each of side panels 9 and 11 includes an end panel 14 and an end panel 17 joined to an intermediate panel 16.

To assemble the tray, side panels 9 and 11 are each turned at 90° to the bottom panel 8 along the scorelines 18 and 19, while the end panels 14 and 17 are turned up on scorelines 21 and 22 and come to rest at 90° to the side panels 16. The end panels 12 and 13 are then turned inwardly to fit over panels 14 and 17 so that in this form the tray is assembled and appears in the lower half of FIGS. 1 and 2. Each of the side panels is provided with ventilation apertures 26 while the end panels 12 and 13 are provided with handholds 27. End panels 14 and 17 are cut away as at 28 to match handholds 27 so that, when assembled, the handholds provide suitable gripping surfaces.

The sleeve 7 is of a generally complementary structure to the tray structure 6 having side panels 31 matching side panels 16 on the tray, and end panels 32 matching end panels 12 and 13 on the tray. At one corner of the sleeve, the overlapping side and end panel are joined as by an adhesive so that a complete sleeve structure is provided.

Mounted upon the side panels and end panels of the sleeve 7 are upper end panels 33 and 34 and upper side panels 36 and 37. The latter are movable along suitable scorelines 38 so that the end panels 33 and 34 can be moved inwardly over whatever is packed in the container while side panels 36 and 37 can be moved into an overlapping relation to the end panels 33 and 34. The movement of these is to provide a cover after the container has been packed. Scorelines 39 in each of the side panels 36 and 37 enable the sections between the scorelines 39 to be torn out for easy access and for opening of the container.

Figure 2:
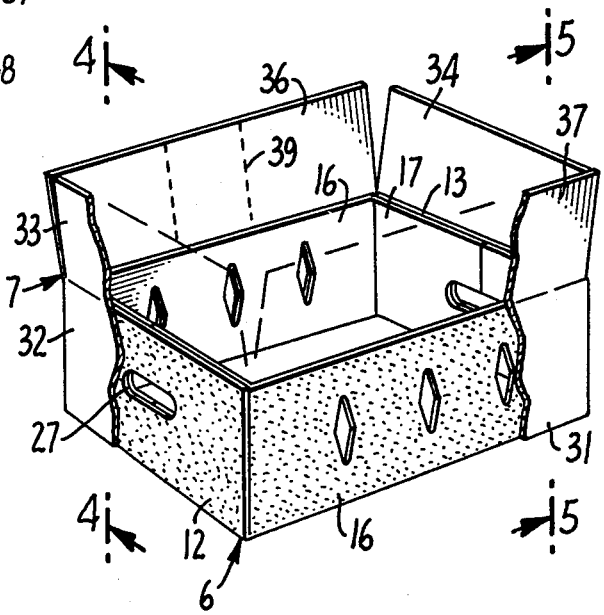
FIG. 2 shows the tray and sleeve assembled, the view being partly broken away to illustrate the construction.

In accordance with this invention, the several outer peripheral surfaces of the tray 6 are covered with an adhesive such as hot or cold glue, the adhesive application being indicated by the stipling in FIGS. 1, 2 and 3. After the glue has been applied, the tray is assembled so that end panels 14 and 17 come to rest against the inside face of each of end panels 12 and 13, thus effecting the joining of the respective abutting surfaces so that the tray appears in the form shown in FIG. 1. The sleeve 7 is then moved into abutting engagement with the several adhesive coated faces on the tray whereby the following defined structure is attained. An improved stacking box having a tray element adapted to fit snugly in an outer sleeve element, the tray element having a bottom panel with side panels extending along opposite sides thereof and end panels extending along opposite ends thereof, said panels being movable on the bottom panel, each side panel having an intermediate side panel portion with movable end panels at each end thereof, each intermediate side panel being movable on the bottom panel and each end panel being movable on the intermediate side panel into a face-to-face engagement with each movable end panel, each of the panels on the bottom panel being of the same height relative to the bottom panel; a sleeve element formed into rectangular form to fit as a sleeve about the assembled tray element in which abutting panels on the sleeve element fit snugly against corresponding panels on the tray element in a full face-to-face abutment with the panels on the assembled tray element; the sleeve element having top panels thereon movable to provide a closure for the assembled sleeve and tray element; and an adhesive interposed between the abutting faces of the elements making up the tray and the abutting faces of the elements making up the sleeve, the adhesive effectively joining the sleeve and tray elements into a unitary container having improved stacking strength.

Figure 4:
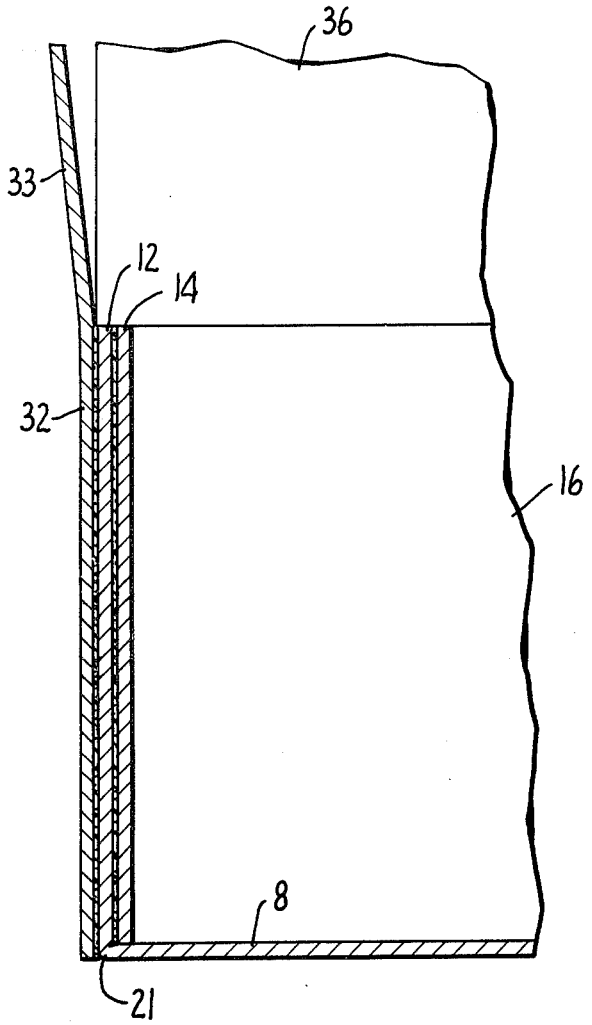
FIGS. 4 and 5 are respectively sections taken along the lines 4—4 and lines 5—5 in FIG. 2.
Figure 5:
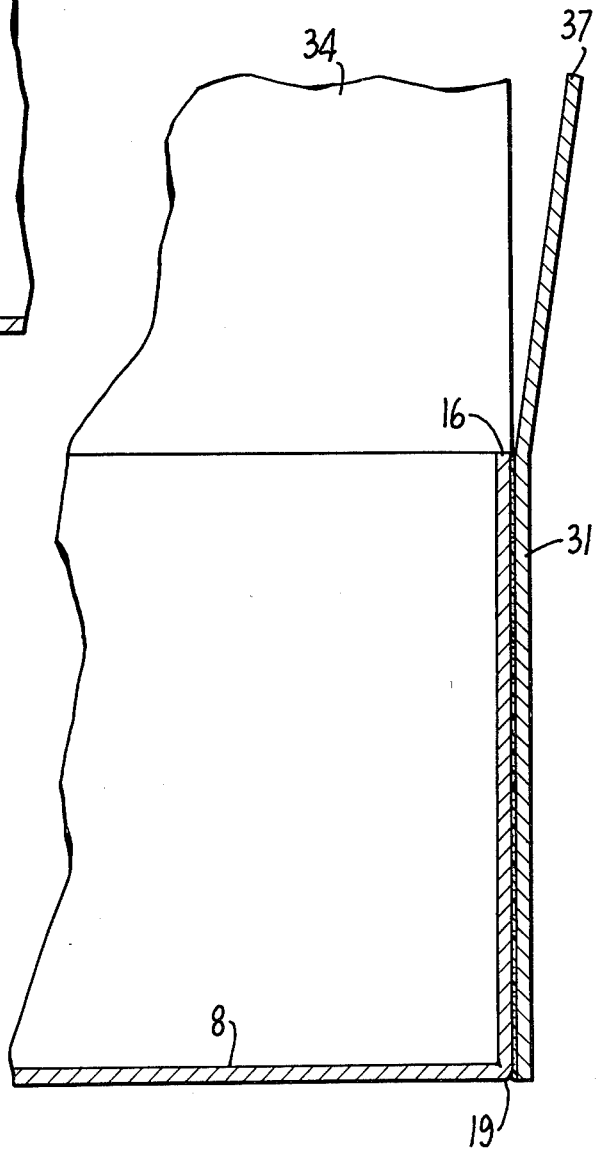

Thus, as is shown by the sections in FIGS. 4 and 5, each end wall of the container is made up of three vertical elements as in FIG. 4, while each side wall shown in FIG. 5 is made up of two vertical elements as in FIG. 5. What is important is that irrespective of the number of elements going to make up an outside wall of the container, each of the elements is joined to one or more abutting elements in a non-slip relationship. If one uses rivets, staples or stitching, the bonding effect is quite localized and the corrugated paper going to make up each of the elements involved will tear or loosen under a load of substantial stacking. The abutting sections will tear, one from the other and collapse in one or more of the lowermost containers. This construction provides vastly increased column strength and enables a much lighter board to be used in construction of the container as compared with the required in the Guyer patent and, in any case, a vastly increased column strength whereby an increased number of the containers can be stacked one upon the other to a substantially increased height as compared to that possible with prior containers.

I claim:

1. An improved stacking box construction comprising a tray element adapted to fit snugly in an outer sleeve element, the tray element having (a) a bottom panel with side panels extending along opposite sides thereof and end panels extending along opposite ends thereof, said end panels each having a handhold defined therein and being attached to said bottom panel by a scoreline and being movable on the bottom panel, each side panel having an intermediate side panel portion with movable side end panels attached by second scorelines at each end thereof, each intermediate side panel having a plurality of ventilation apertures defined therein and being movable on the bottom panel and each side end panel having a cut away portion defined therein at an end thereof remote from said second scorelines and being movable on the intermediate side panel into a face-to-face engagement with each movable end panel, said handholds being located on said end panels and said cut aways being located on said movable side end panels to be coincident with each other when said movable side end panels are in face-to-face engagement with said end panels with said cut aways each being about half the length of a handhold and said movable side end panels each being about half the length of an end panel so that said movable side end panels and said end panels form a double thickness wall, said cut aways surrounding said handhold, each of the panels on the bottom panel being of the same height relative to the bottom panel;

(b) a sleeve element formed into rectangular form to fit as a sleeve about the assembled tray element in which abutting panels on the sleeve element fit snugly against corresponding panels on the tray element in a full face-to-face abutment with the panels on the assembled tray element;

(c) the sleeve element having a pair of side panels each having a plurality of ventilation apertures defined therein which correspond to the ventilation apertures defined in said tray element, a pair of end panels each having a handhold defined therein to correspond to said tray handholds, top panels, and said top end panels being connected to said sleeve by sleeve scorelines to be movable to provide a closure for the assembled sleeve and tray element;

(d) and an adhesive interposed between the abutting faces of the elements making up the tray and the abutting faces of the elements making up the sleeve, the adhesive effectively joining the sleeve and tray elements into a unitary container, said unitary container having end walls each of which has a triple thickness throughout and handholds therein, side walls each of which has a double thickness throughout and ventilation apertures defined therein and a single thickness bottom so that said unitary container has improved stacking strength.

* * * * *